US011931796B2

(12) United States Patent
Sieglhuber et al.

(10) Patent No.: US 11,931,796 B2
(45) Date of Patent: Mar. 19, 2024

(54) METHOD FOR CASTING A MELT BY MEANS OF A MELT CONTAINER IN WHICH A MELT RECEIVING SPACE IS FORMED

(71) Applicant: Fill Gesellschaft m.b.H., Gurten (AT)

(72) Inventors: Gerhard Sieglhuber, Muehlheim am Inn (AT); Harald Sehrschoen, Waldzell (AT); Johannes Voithofer, Haag am Hausruck (AT)

(73) Assignee: Fill Gesellschaft m.b.H., Gurten (AT)

( * ) Notice: Subject to any disclaimer, the term of this patent is extended or adjusted under 35 U.S.C. 154(b) by 183 days.

(21) Appl. No.: 17/784,337

(22) PCT Filed: Dec. 11, 2020

(86) PCT No.: PCT/AT2020/060446
§ 371 (c)(1),
(2) Date: Jun. 10, 2022

(87) PCT Pub. No.: WO2021/113892
PCT Pub. Date: Jun. 17, 2021

(65) Prior Publication Data

US 2023/0038351 A1 Feb. 9, 2023

(30) Foreign Application Priority Data

Dec. 13, 2019 (AT) ..... A 51095/2019

(51) Int. Cl.
*B22D 39/06* (2006.01)
*B22D 11/10* (2006.01)
(Continued)

(52) U.S. Cl.
CPC ..... *B22D 11/10* (2013.01); *B22D 17/28* (2013.01); *B22D 17/30* (2013.01); *B22D 35/04* (2013.01); *B22D 39/06* (2013.01); *B22D 41/08* (2013.01)

(58) Field of Classification Search
CPC ..... B22D 17/30; B22D 35/00; B22D 35/04; B22D 39/06; B22D 41/12; B22D 41/13; B22D 41/14
See application file for complete search history.

(56) References Cited

U.S. PATENT DOCUMENTS 3,514,519 A 5/1970 Schempp et al.
5,131,452 A 7/1992 Bilz et al.
(Continued)

FOREIGN PATENT DOCUMENTS

CA 2023891 A1 8/1991
CN 1168827 A 12/1997
(Continued)

OTHER PUBLICATIONS

EPO machine translation of JP 11-33696 A (Year: 1999).*
International Search Report in PCT/AT2020/060446, dated Feb. 10, 2021.

*Primary Examiner* — Kevin E Yoon
(74) *Attorney, Agent, or Firm* — Collard & Roe, P.C.

(57) ABSTRACT

A method for casting a melt uses a melt container in which a melt receiving space is formed. The melt container has a spout in the form of a lance on the bottom on the melt container. The method includes the following steps: filling the melt container with melt, wherein the melt is introduced into the melt receiving space of the melt container from a crucible using a spout orifice of the lance; casting at least one cast workpiece with melt; filling the melt container with melt again. When filling the melt container with melt, more melt is received in the melt receiving space than is needed for casting the cast workpiece. Directly before the renewed filling of the melt container, a remainder of melt having an oxide skin formed at the melt surface is present in the melt receiving space of the melt container.

11 Claims, 9 Drawing Sheets

Figure 1:
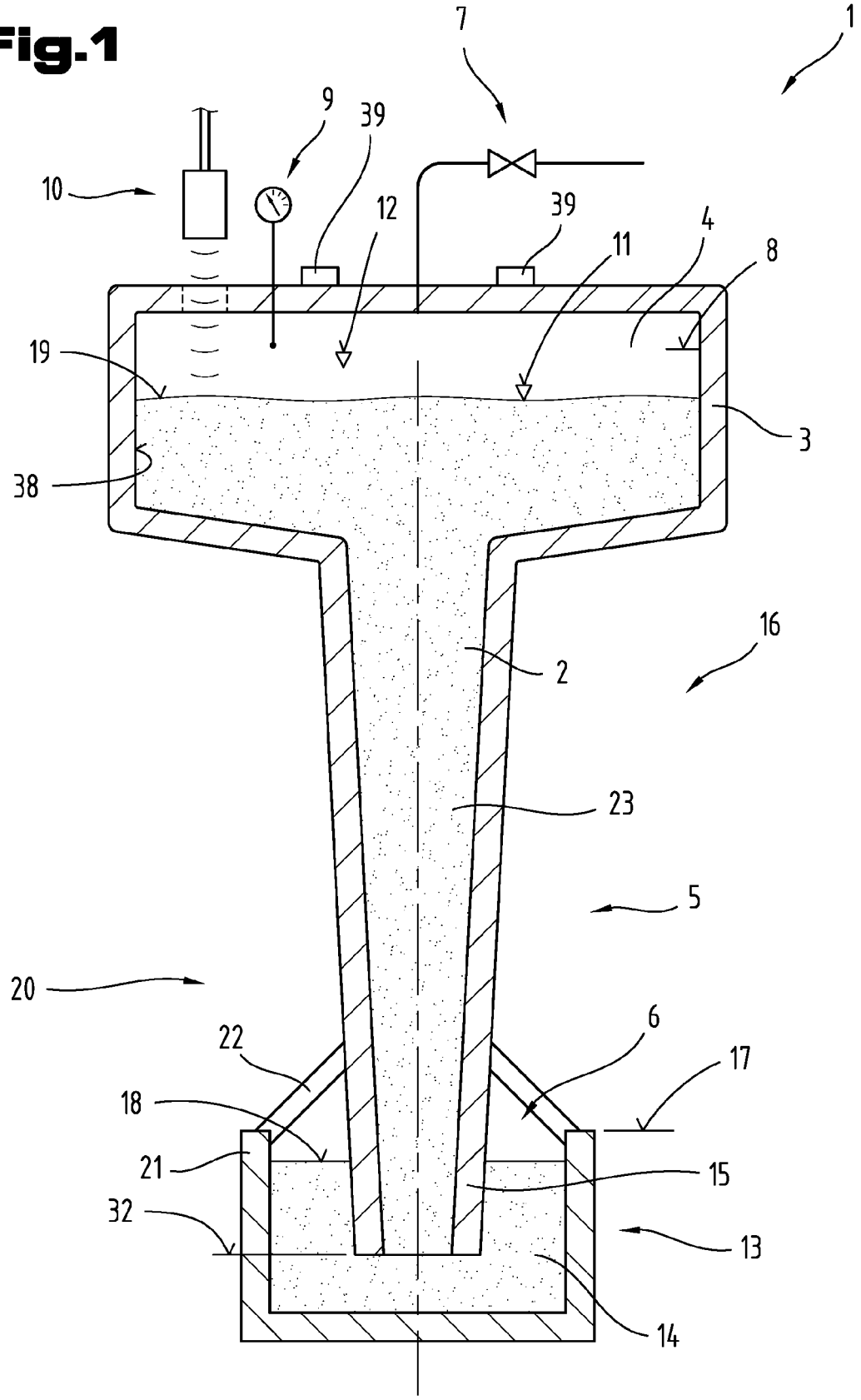

(51) Int. Cl.

| | |
|---|---|
| ***B22D 17/28*** | (2006.01) |
| ***B22D 17/30*** | (2006.01) |
| ***B22D 35/04*** | (2006.01) |
| ***B22D 41/08*** | (2006.01) |

(56) References Cited

U.S. PATENT DOCUMENTS

| | | | |
|---|---|---|---|
| 6,332,357 | B1 | 12/2001 | Matsuura et al. |
| 10,092,950 | B2 | 10/2018 | Segaud et al. |
| 10,537,936 | B2 | 1/2020 | Schulte-Vorwick et al. |
| 2021/0237150 | A1 | 8/2021 | Rihtaric |

FOREIGN PATENT DOCUMENTS

| | | | | | |
|---|---|---|---|---|---|
| CN | 1853828 | A | | 11/2006 | |
| CN | 109482852 | A | | 3/2019 | |
| DE | 10 2007 011 253 | A1 | | 9/2008 | |
| DE | 10 2009 004 613 | A1 | | 7/2010 | |
| DE | 10 2011 120 224 | A1 | | 6/2013 | |
| DE | 10 2014 205 388 | A1 | | 9/2015 | |
| EP | 0 799 661 | A2 | | 10/1997 | |
| EP | 1 428 599 | A1 | | 6/2004 | |
| EP | 2407260 | A1 | * | 1/2012 | ..... B22D 17/30 |
| EP | 3 274 113 | B1 | | 1/2019 | |
| FI | 112448 | B1 | * | 12/2003 | ..... B22D 17/30 |
| GB | 954214 | A | | 4/1964 | |
| JP | H11-33696 | A | | 2/1999 | |
| JP | 2000-042723 | A | | 2/2000 | |
| LU | 39075 | A1 | | 7/1960 | |
| WO | 2019/204845 | A1 | | 10/2019 | |

* cited by examiner

METHOD FOR CASTING A MELT BY MEANS OF A MELT CONTAINER IN WHICH A MELT RECEIVING SPACE IS FORMED

CROSS REFERENCE TO RELATED APPLICATIONS

This application is the National Stage of PCT/AT2020/060446 filed on Dec. 11, 2020, which claims priority under 35 U.S.C. § 119 of Austria Application No. A51095/2019 filed on Dec. 13, 2019, the disclosure of which is incorporated by reference. The international application under PCT article 21(2) was not published in English.

The invention relates to a method for casting a melt by means of a melt container in which a melt receiving space is formed.

DE 10 2007 011 253 A1 discloses a casting device having a melt container for metallic materials. On the bottom side of the melt container, an injector is arranged, which has an orifice for discharging the melt. Moreover, a closing device is formed, which serves to close the orifice.

Further such casting devices having an injector are known from EP 3 274 113 B1 and DE 10 2009 004 613 A1. Furthermore, the master's thesis "Klassifizierung und Charakterisierung von verfahrensbedingten Gussfehlern in einem innovativen Kokillen-Gießverfahren" (Classification and analysis of process-based casting defects caused by an innovative gravity die casting process), which was submitted at the Montanuniversität Leoben in February 2014, discloses such a casting device with an injector as well as a casting method which can be carried out by it.

Further casting devices having a lance are known from JP H11 33696 A, EP 1 428 599 A1 and U.S. Pat. No. 6,332,357 B1.

WO 2019/204845 A1 discloses a low-pressure casting device.

It was the object of the present invention to overcome the shortcomings of the prior art and to provide an improved device and a method for casting a melt.

This object is achieved by means of a device and a method according to the claims.

The invention relates to a method for casting a melt by means of a melt container in which a melt receiving space is formed, wherein the melt container has a spout in the form of a lance located on the bottom on the melt container, wherein the method comprises the following method steps:

- filling the melt container with melt, wherein the melt is introduced into the melt receiving space of the melt container out of a crucible by means of a spout orifice of the lance;
- casting at least one cast workpiece with melt from the melt container, wherein the melt received in the melt receiving space is introduced into a mold via the spout orifice of the lance;
- filling the melt container with melt again.

When filling the melt container with melt, more melt is received in the melt receiving space than is needed for casting the cast workpiece, so that after completion of the casting process of the cast workpiece, a remainder of melt having an oxide skin formed at the melt surface remains in the melt receiving space of the melt container.

The method according to the invention entails the advantage that the oxide skin, which forms, is not introduced into the mold. Thereby, the quality of the cast workpiece can be improved. Moreover, the method according to the invention entails the advantage that the oxide skin does not reach the spout of the melt container, whereby the dirtying of the spout of the melt container can be prevented. In particular, this allows achieving that the melt container remains functional over a longer period of time, as a dirtying of the spout would reduce the functionality of the melt container for future castings. Furthermore, the measures according to the invention can prevent a freezing of oxide skin residues and/or melt residues in the spout. Particularly in the case of aluminum or aluminum alloys, an oxide skin is quick to form at the surface.

Moreover, it may be useful if, for filling the melt receiving space of the melt container, the lance is immersed in a crucible filled with melt such that the spout orifice of the lance lies below the crucible fill level during the entire filling operation. This entails the advantage that, by immersing the lance in the crucible filled with melt, the melt can be introduced into the melt receiving space of the melt container via the lance, which simultaneously acts as a spout.

In a first embodiment variant, the lance can be immersed in the crucible so deeply that, due to gravity, the melt enters from the crucible into the melt receiving space of the melt container because of the effect of containers communicating with one another.

In an alternative embodiment variant, a negative pressure may be applied in the melt receiving space of the melt container, resulting in the melt being sucked into the melt receiving space by the crucible.

Furthermore, it may be provided that during and/or directly before immersing the lance in the crucible, at least a part of the melt remaining in the melt receiving space of the melt container is discharged into the crucible. This entails the advantage that the discharged melt breaks and/or displaces the oxide skin in the crucible, such that upon immersion of the lance in the crucible, the oxide skin is displaced by the lance and thus, the oxide skin can be prevented from adhering to the lance. On the one hand, this entails the surprising advantage that the quality of the melt received in the melt receiving space can be improved. Furthermore, this measure helps avoid that the oxide skin present in the crucible clogs the lance. Additionally, these measures entail the advantage that the oxide skin present in the crucible does not adhere to the outer side of the lance, whereby the longevity of the lance can be improved.

Moreover, it may be provided that the melt receiving space of the melt container has a non-wettable surface, in particular a ceramic surface, to which the oxide skin of the melt does not adhere. This entails the advantage that the oxide skin present in the melt receiving space of the melt container can move upwards and/or downwards during the filling process and/or the emptying process, depending on the fill level of the melt container, without resulting in a mixing with the melt.

An embodiment according to which it may be provided that while filling the melt container with melt, between 1% and 30%, in particular between 5% and 20%, preferably between 10% and 15%, more melt is received in the melt receiving space than is required for casting the cast workpiece, is also advantageous. Particularly a filling in this value range entails a surprisingly good efficiency of the casting process. Moreover, the freezing of the melt can be prevented particularly efficiently, and a good melt quality can be achieved in case of a filling in this value range.

According to an advancement, it is possible that the melt receiving space of the melt container is emptied completely in periodic intervals and/or before shutting down the melt container, and the oxide skin is blown out of the melt receiving space by means of a gas blast. This entails the advantage that even when shutting the melt container down, no oxide skin remains in the melt receiving space and/or that the melt receiving space can be thoroughly cleaned in periodic intervals.

Moreover, it may be useful if the oxide skin present in the melt receiving space at the surface of the melt is sucked off in periodic intervals and/or before shutting the melt container down. This entails the advantage that even when shutting the melt container down, no oxide skin remains in the melt receiving space and/or that the melt receiving space can be thoroughly cleaned in periodic intervals.

Furthermore, it may be provided that the oxide skin present in the melt receiving space at the surface of the melt is discharged in periodic intervals and/or before shutting the melt container down by means of an oxide skin discharge orifice formed in the melt container. This entails the advantage that even when shutting the melt container down, no oxide skin remains in the melt receiving space and/or that the melt receiving space can be thoroughly cleaned in periodic intervals.

Moreover, it may be provided that the melt receiving space is designed such that when it is at least partially filled with melt, it is closed off in a gas-tight manner, wherein a gas valve is formed, by means of which gas can be fed into or removed from the melt receiving space, wherein the gas valve is opened while the melt container is being filled with melt, so that the melt can flow out of the crucible and into the melt receiving space via the lance, and the gas valve is closed after the melt has flown in, and subsequently, while the gas valve is closed, melt is discharged from the melt receiving space back into the crucible via the lance until a vacuum is generated that is sufficient to keep the remaining melt in the melt receiving space. This entails the advantage that the melt container does not have to be designed to be able to generate a vacuum in the melt receiving space, but that merely a valve for introducing gas into the melt receiving space and/or for discharging gas out of the melt receiving space suffices. In a first embodiment variant, it may be provided in this regard that the melt is pushed into the melt receiving space by means of a pressure pipe, such as the pipe of a low-pressure furnace, which is coupled to the lance.

In a further embodiment variant, it may be provided that the melt container is immersed in the crucible filled with melt so deeply that, due to gravity, the melt flows into the crucible via the lance because of the containers communicating with one another.

Moreover, it may be provided that when casting the at least one cast workpiece, the melt is admitted, in a first method step, from the melt container into the mold at a first inflow speed until the spout orifice is immersed at least partially in the melt introduced into the mold, and that in a second method step, the melt is admitted into the mold at a second inflow speed, wherein the second inflow speed is greater than the first inflow speed. This entails the advantage that the turbulences during admission of the melt into the mold can be kept as minimal as possible.

Moreover, it may be provided that while filling the melt container with melt, in a first method step, the lance is moved, in particular pivoted, at the surface of the crucible such that the oxide skin at the surface is torn open and in a second method step, the lance is immersed in the melt present in the crucible in the torn region of the oxide skin. This entails the advantage that by this measure, the oxide skin can be kept away from the lance, so that the lance can be kept from being dirtied by the oxide skin as much as possible.

In particular, it can be provided that the oxide skin is torn by means of the immersion aid.

The lance within the meaning of this document is a spout with a cross-section that is constricted relative to the melt container. In particular, it may be provided that the lance is formed to be tubular at least in some regions.

Furthermore, it may be provided that during the filling of the melt container with melt, so much more melt is received in the melt receiving space that when the melt container is filled anew with melt, the level of the melt surface of the melt remaining in the melt receiving space lies above the lance, in particular inside the melt receiving space. This entails the advantage that the oxide skin situated at the melt surface remains in a region with a roughly constant cross-section and thus is not excessively deformed. Thus, the oxide skin is not mixed with the melt.

For the purpose of better understanding of the invention, it will be elucidated in more detail by means of the figures below.

Figure 5:
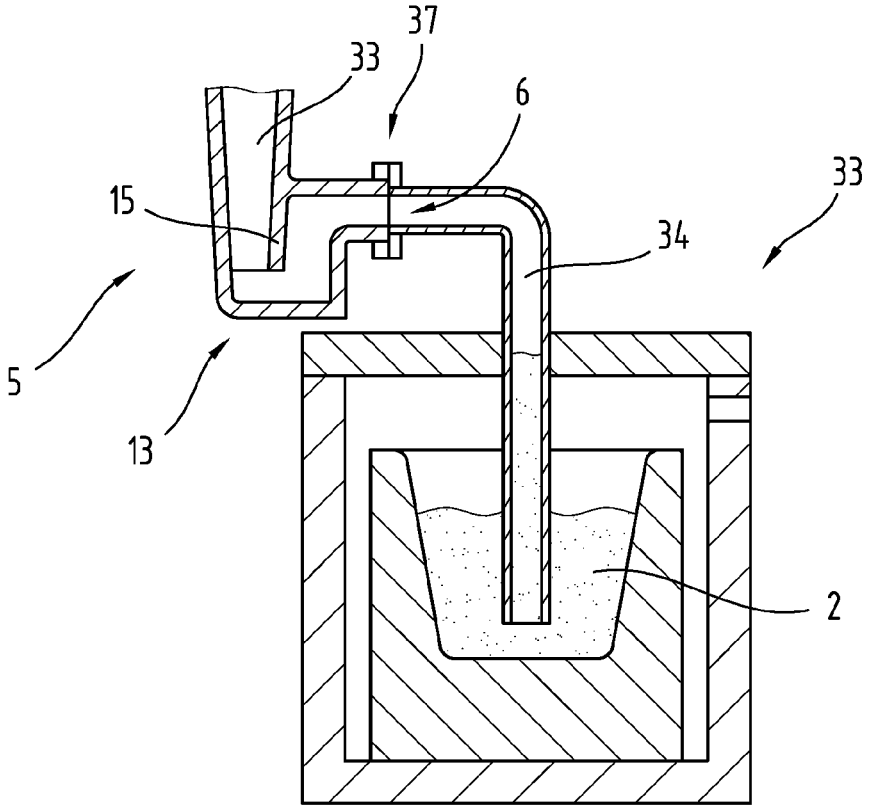
Figure 6:
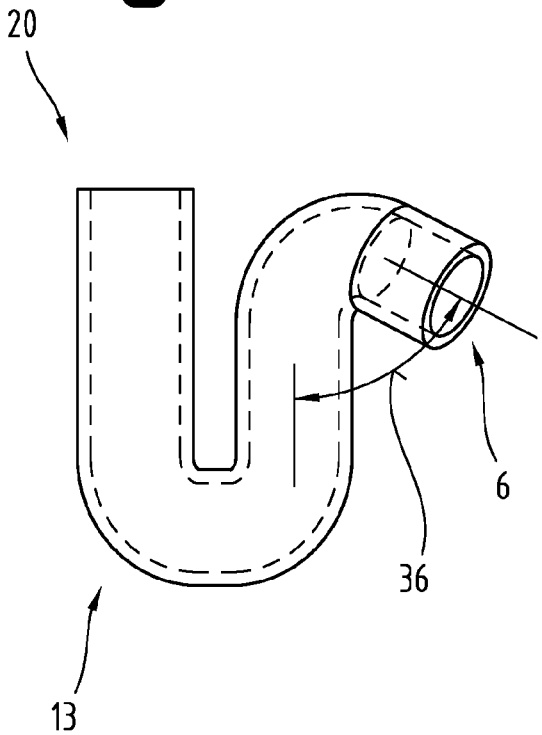
Figure 7:
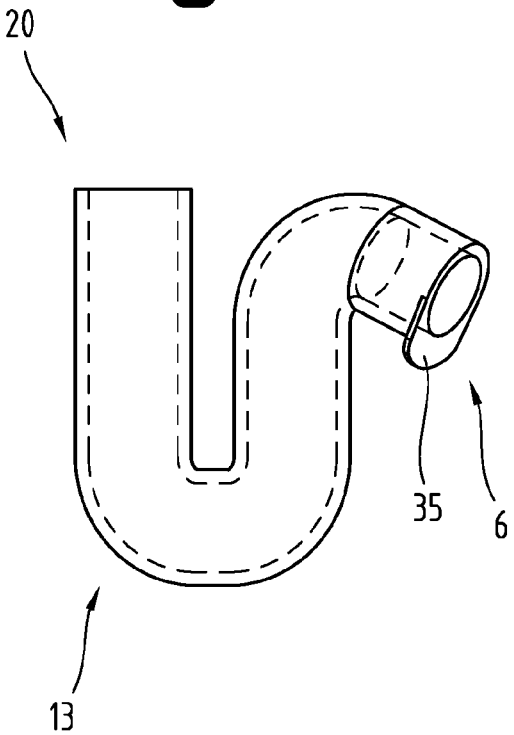
Figure 8:
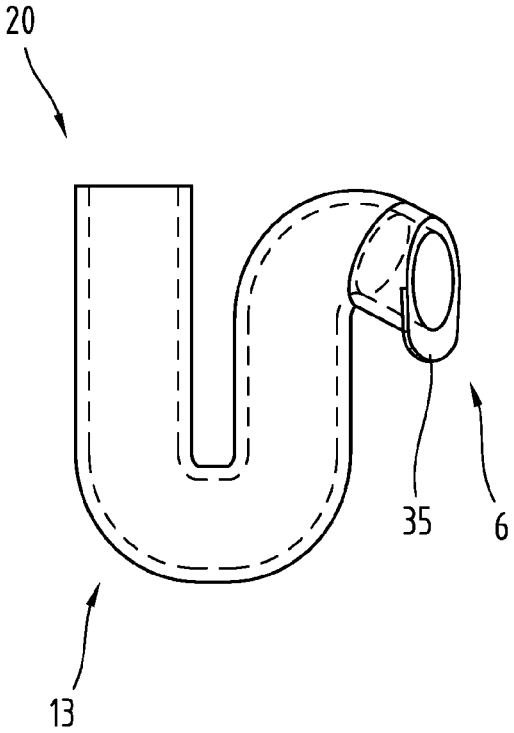
Figure 9:
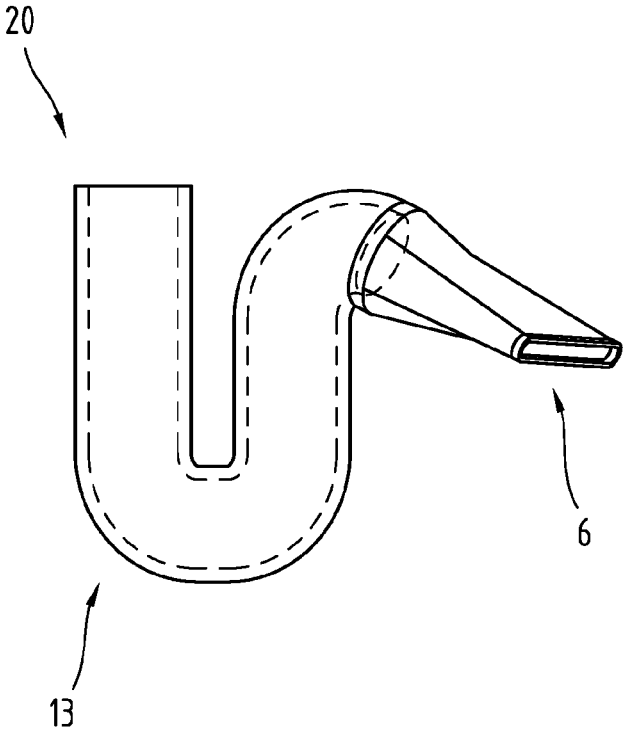
Figure 10:
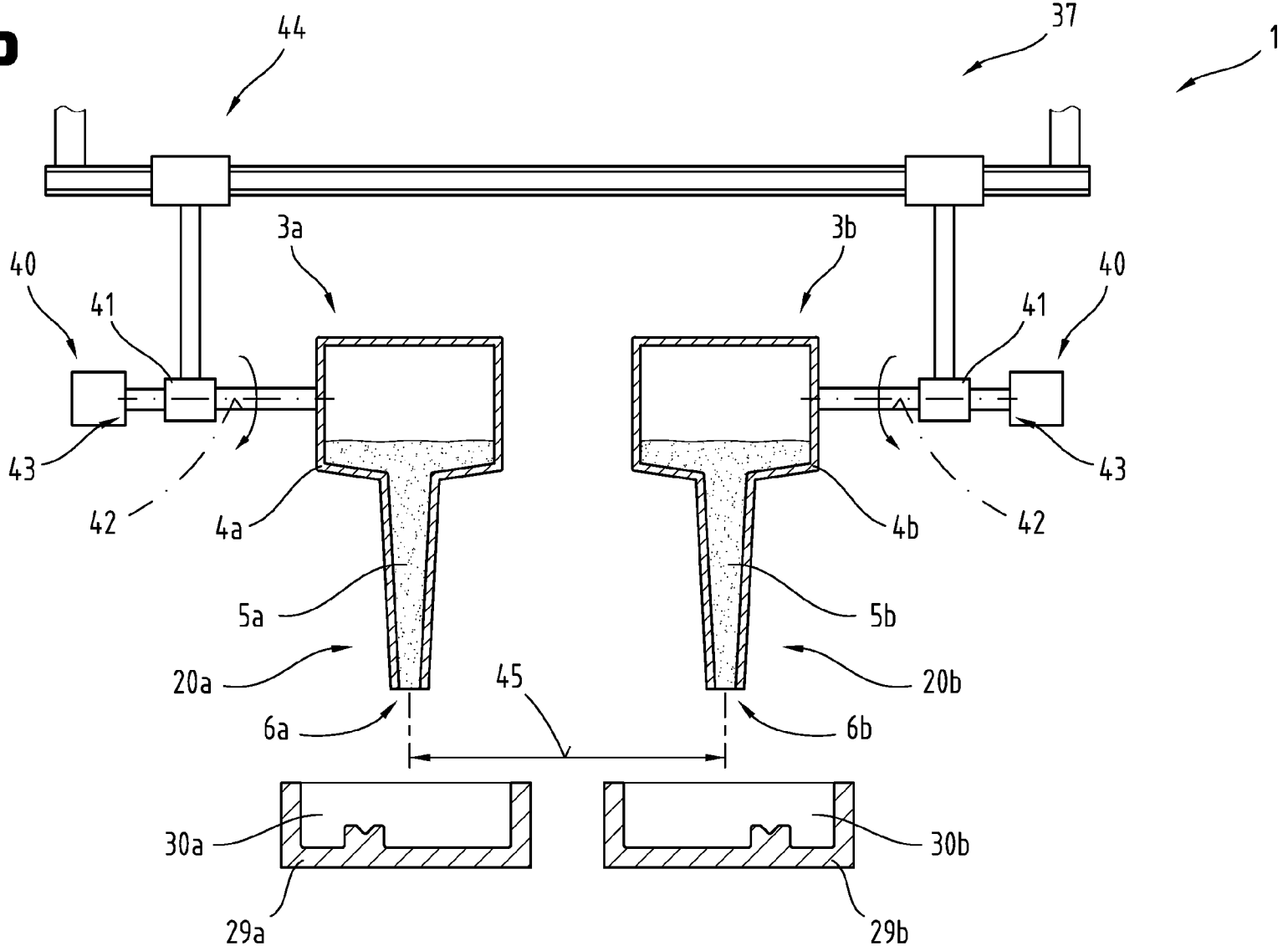
Figure 11:
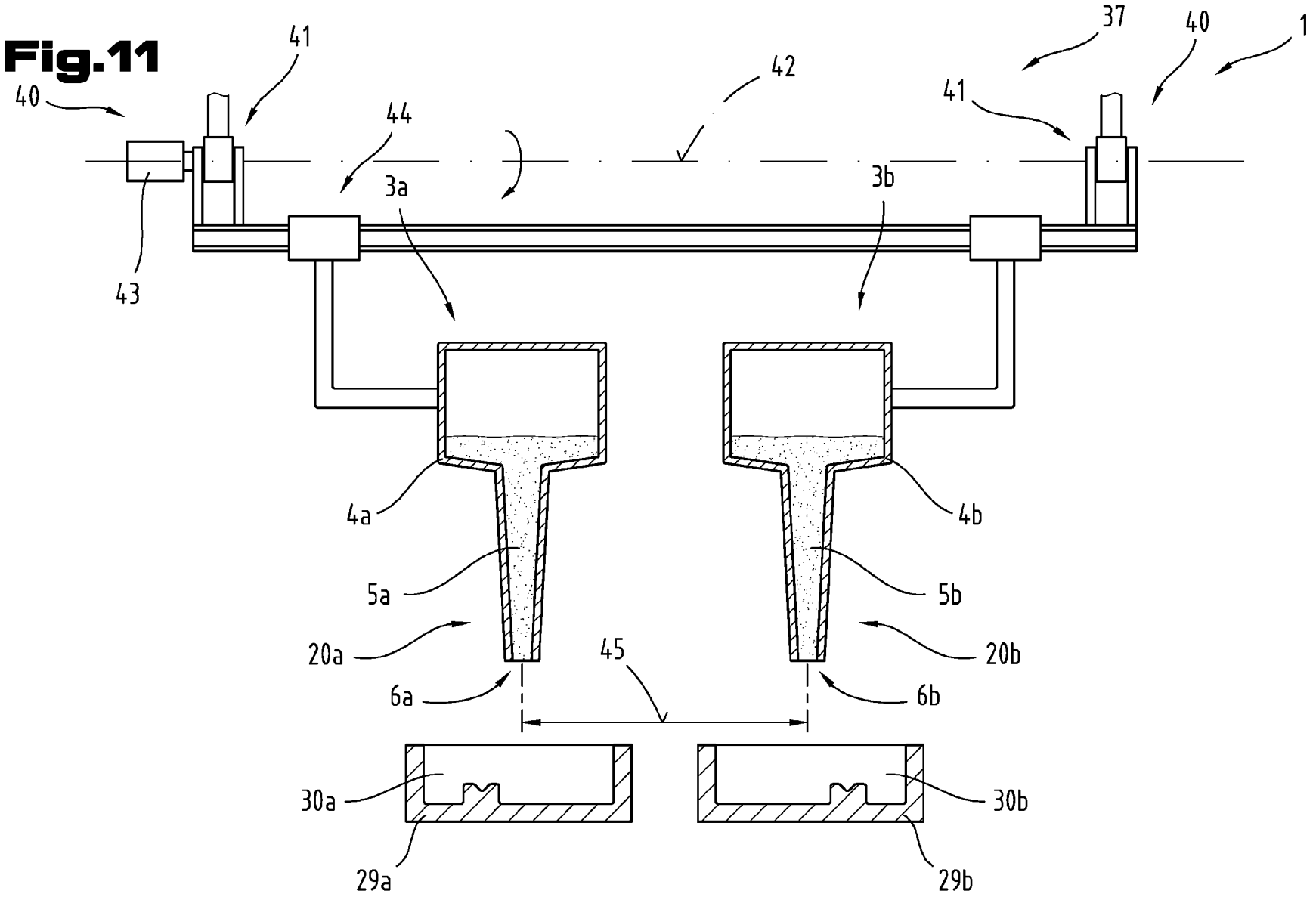
Figure 12:
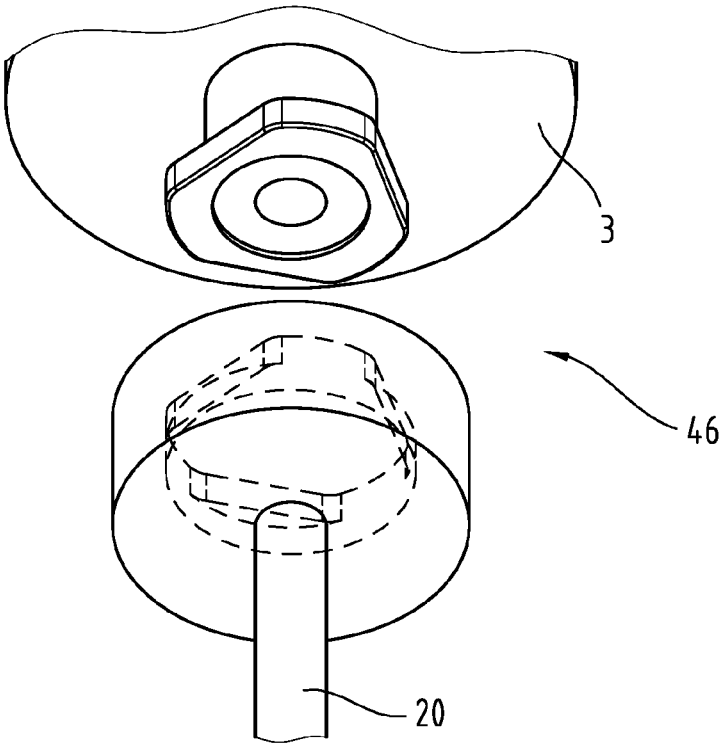

These show in a respectively very simplified schematic representation:

FIG. 1 a schematic sectional view of a first exemplary embodiment of a melt transport device with a siphon;

FIG. 2 individual method steps of an initial filling operation for filling a melt receiving space with melt;

FIG. 3 individual method steps of a further filling operation for filling a melt receiving space with melt;

FIG. 4 individual method steps of an alternative filling operation for filling a melt receiving space with melt;

FIG. 5 a schematic representation of a further alternative filling operation for filling a melt receiving space with melt using a low-pressure furnace;

FIG. 6 a first embodiment variant of a spout orifice;

FIG. 7 a second embodiment variant of a spout orifice;

FIG. 8 a third embodiment variant of a spout orifice;

FIG. 9 a fourth embodiment variant of a spout orifice;

FIG. 10 a first exemplary embodiment of a casting device;

FIG. 11 a second exemplary embodiment of a casting device;

FIG. 12 an exemplary embodiment of a quick-release connector for coupling a lance to a melt container.

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

FIG. 1 shows a first exemplary embodiment of a melt transport device 1 which serves for transporting melt 2.

The melt transport device 1 has a melt container 3, in which a melt receiving space 4 is formed, which serves to receive the melt 2. On its inner side, the melt receiving space 4 has a surface 38, which is in contact with the melt 2 when the melt receiving space 4 is filled.

Moreover, the melt transport device 1 comprises a spout 5, which is coupled to the melt container 3. The spout 5 may be designed as an integral component of the melt container 3. Moreover, it is also conceivable that the spout 5 is formed as a separate component which is coupled to the melt container 3. The spout 5 has a spout orifice 6, via which the melt 2 received in the melt container 3 can flow out of the melt transport device 1 into a mold.

The spout orifice 6 may have a circular cross-section. Furthermore, it is also conceivable that the spout orifice 6 has a square cross-section. Moreover, it is also conceivable that the spout orifice 6 has a rectangular cross-section, wherein in particular a longitudinal extension of the spout orifice 6, which extends normal to the section plane, may have a great extension. For example, the longitudinal extension of the spout orifice 6 may measure up to 2000 mm, in particular up to 500 mm. This is advantageous particularly in elongated cast workpieces, such as cylinder blocks or cylinder heads.

Of course, this longitudinal extension of the spout orifice 6 may also be advantageous for the other embodiment variants.

Moreover, a gas valve 7 is formed, which is flow-connected to the melt receiving space 4 and which is designed for regulating the introduction of gas into the otherwise gas-tight melt receiving space 4. The gas valve 7 is arranged above a fill level maximum 8, so that no melt 2 can flow into the gas valve 7. The fill level maximum is selected such that when the melt container 3 is filled to the fill level maximum 8 with melt 2, a gas-filled space still remains in the melt receiving space 4, in which gas-filled space a pressure can be set by means of the gas valve 7.

Moreover, a pressure determining means 9 may be provided, by means of which an internal pressure in the melt receiving space 4 can be determined. Thus, the gas pressure in the melt receiving space 4 can be adjusted in a targeted manner by the gas valve 7.

As may further be gathered from the exemplary embodiment according to FIG. 1, it may be provided that the melt transport device 1 comprises a fill level sensor 10, which serves to determine the actual fill quantity level 11. The actual fill quantity level 11 can thus be continuously determined and compared to a target fill quantity level 12.

Moreover, a weighing cell 39 may be formed, by means of which the weight and thus the fill level of the melt receiving space 4 can be determined.

As can further be seen from FIG. 1, it may be provided that the melt transport device 1 has a siphon 13, which has a reservoir 14, which is arranged between the melt receiving space 4 and the spout orifice 6. Moreover, a siphon wall 15 is formed, which protrudes into the reservoir 14 in such a manner that, when the reservoir 14 is filled with melt up to an overflow level 17, the melt receiving space4 is closed in a gas-tight manner with respect to a melt container outer side 16. In this regard, the siphon 13 in the spout 5 is designed such that the reservoir 14 has the overflow level 17, wherein the siphon wall 15 is designed such that it has a siphon wall bottom edge 32. The siphon wall 15 protrudes into the reservoir 14 such that a siphon wall bottom edge 32 is arranged at a lower level than the overflow level 17.

FIG. 1 shows the melt container 3 partially filled with melt 2. As can be seen in FIG. 1, the structure described results in a first melt surface 18, which is arranged on and/or assigned to the melt container outer side6. Moreover, a second melt surface 19 is formed, which is arranged in the melt receiving space 4 of the melt container 3. The second melt surface 19 corresponds to the actual fill quantity level 11. The ambient pressure of the melt container 3 acts on the first melt surface 18. The internal pressure of the melt receiving space 4 acts on the second melt surface 19.

For transporting the melt container 3, it may be advantageous if the first melt surface 18 is situated slightly below the overflow level 17, as shown in FIG. 1. As a result, a spilling of the melt 2 can be prevented as well as possible. This level difference can be achieved, for example by reducing the pressure in the melt receiving space 4. Alternatively, the melt container 3 can be shaken or slightly tilted directly after filling in order to achieve this level difference directly after filling the melt container 3. Of course, it is also possible that the melt container 3 is manipulated while the level of the first melt surface 18 is equal to the overflow level 17.

As can further be gathered from FIG. 1, it may be provided that the spout 5 is designed in the form of a lance 20 and that the siphon 13 is arranged on the bottom side of the lance 20. In the representations of the exemplary embodiments, the lance 20 is shown with an exaggerated diameter for the sake of improved clarity. In particular, it can be provided that the lance 20 is formed to be slimmer than shown and thus has a greater length compared to its diameter.

Moreover, it may of course be provided that the siphon 13 is integrated directly into the lance 20. A siphon 13 integrated into the lance 20 can work according to the same operating principle as described here.

In the exemplary embodiment according to FIG. 1, the siphon 13 may comprise a container 21 that is open towards the top, which is coupled to the spout 5 by means of struts 22. In this exemplary embodiment, a top edge of the container 21 simultaneously defines the overflow level 17. If, in the present exemplary embodiment according to FIG. 1, gas is admitted to the melt receiving space 4 by means of the gas valve 7, the second melt surface 19 is lowered, resulting in the melt 2 present int he melt receiving space 4 flowing through a spout channel 23 into the reservoir 14, whereby the first melt surface 18 rises. The first melt surface 18 rises in this process until the melt 2 flows out over the overflow level 17.

Moreover, it may also be provided that the container 21 that is open towards the top is arranged on the spout 5 in an exchangeable manner.

As can be further gathered from FIG. 1, it may be provided that it is further possible that an immersion aid 47 is arranged on the bottom side of the lance 20*a*, 20*b*. The immersion aid 47 serves to tear open the oxide skin present at the surface of the crucible 25 when the lance 20*a*, 20*b* is being immersed in the crucible 25, so that the lance 20*a*, 20*b* can be immersed below the layer of the oxide skin for filling the melt container and consequently, as far as possible, the oxide skin does not get into the melt receiving space 4 when the melt container 3 is being filled. In particular, it can be provided that the immersion aid 47 has a pointed shape, so that the tearing of the oxide skin can be facilitated.

Moreover, it may be provided that the bottom side of the lance 20*a*, 20*b* and/or the immersion aid 47 is designed such that they have no protruding surfaces, so that, as far as possible, no oxide skin adheres to the lance 20*a*, 20*b* when the lance 20*a*, 20*b* is being pulled out of the crucible 25. In particular, it may be provided that all surfaces of the lance 20*a*, 20*b* directed upwards are formed to be pointing downwards in a conical and/or oblique manner, so that the oxide skin is repelled when the lance 20*a*, 20*b* is being pulled out.

Figure 2C:
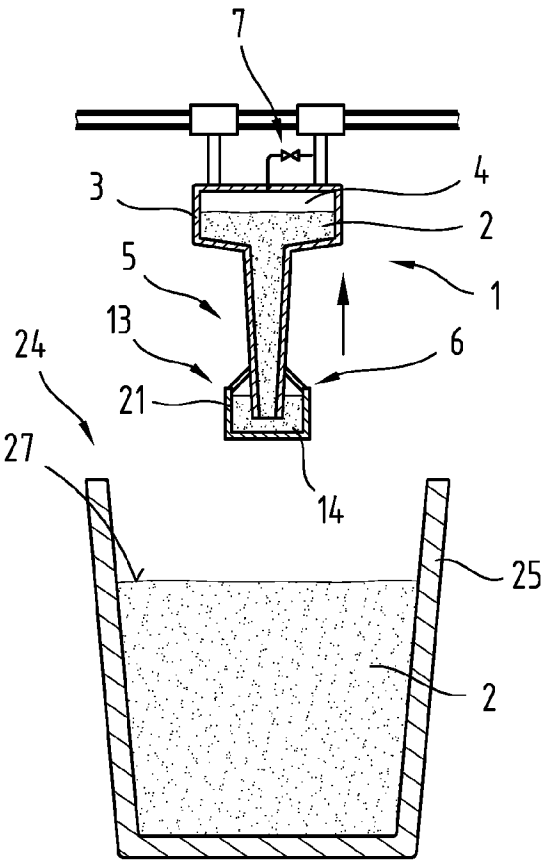
Figure 2B:
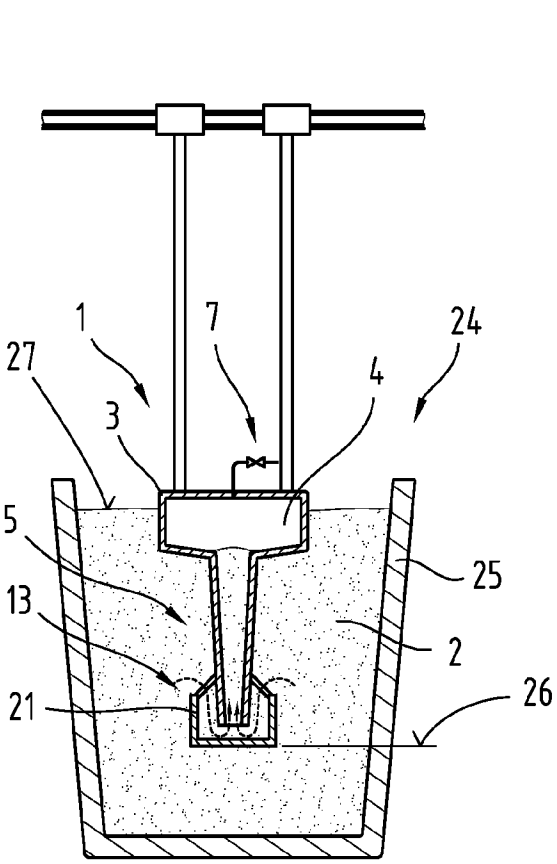
Figure 2A:
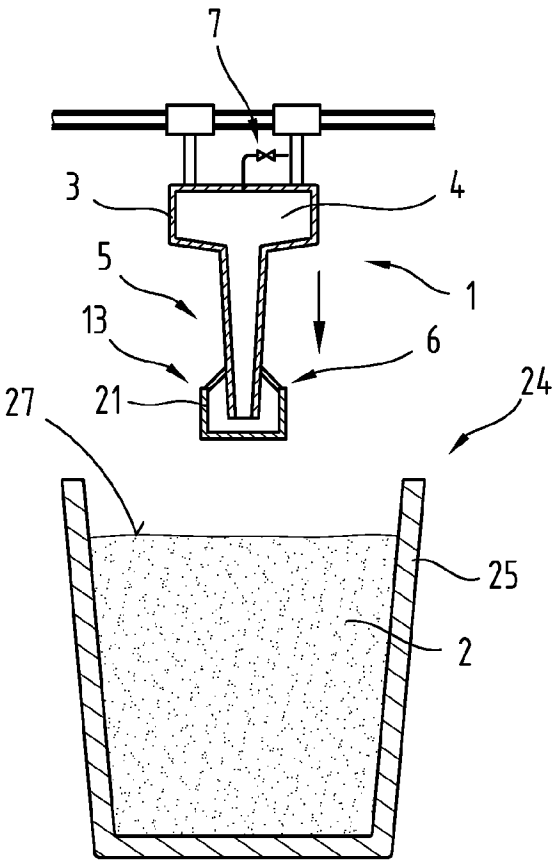

FIGS. 2*a* to 2*c* show a further and possibly independent embodiment of the melt transport device 1, wherein again, equal reference numbers and/or component designations are used for equal parts as in FIG. 1 above. In order to avoid unnecessary repetitions, it is pointed to/reference is made to the detailed description in FIG. 1 preceding it.

FIGS. 2*a* to 2*c* schematically show a possible filling operation for filling the melt receiving space 4 with melt 2.

As can be seen in FIG. 2*a*, it may be provided that the melt 2 is provided in a crucible 25 of a melt furnace 24 and that the melt container 3 is positioned above the crucible 25.

As can be seen in FIG. 2*b,* in a further method step, the melt container 3 can be at least partially immersed in the melt 2 arranged in the crucible 25, so that the spout orifice 6 is immersed below the crucible fill level 27 if the melt 2 in the crucible 25. If the gas valve 7 is then opened and/or is already open upon immersion, the melt 2 can flow into the melt receiving space 4 of the melt container 3 via the spout orifice 6. This position of the melt container 3 may also be referred to as the filling position 26.

If the gas flowing out of the melt receiving space 4 is able to pass the gas valve 7 without pressure, the actual fill quantity level 11 will adapt to the furnace fill level 27 when the melt container 3 is filled. During the subsequent closing of the gas valve 7 and lifting of the melt container 3, the actual fill quantity level 11 will be lowered until the vacuum in the melt receiving space 4 is great enough to keep the melt 2 at the same level due to the pressure difference between the interior pressure in the melt receiving space 4 and the ambient pressure.

Once the target fill quantity level 12 in the melt receiving space 4 is reached, the gas valve 7 can be closed again and the melt container 3 can be lifted again, as shown in FIG. 2*c.*

Here, when lifting the melt container 3, melt 2 flows out of the melt receiving space 4 back into the crucible 25 until a pressure lower than the ambient pressure arises in the melt receiving space 4, which pressure keeps the melt in the melt receiving space 4.

In an advancement, it may be provided that subsequently, by opening the gas valve 7, melt 2 is further discharged from the melt receiving space 4 until a desired fill level of melt 2 is reached in the melt receiving space4. In this regard, the desired fill level of melt 2 can be selected such In this regard this desired fill level of melt 2 in the melt receiving space 4 is selected such that after casting the cast workpiece or the cast workpieces, a remainder of melt 2 remains in the melt receiving space 4.

In a subsequent method step, the melt container 3 can be transported to its casting position.

Figure 3C:
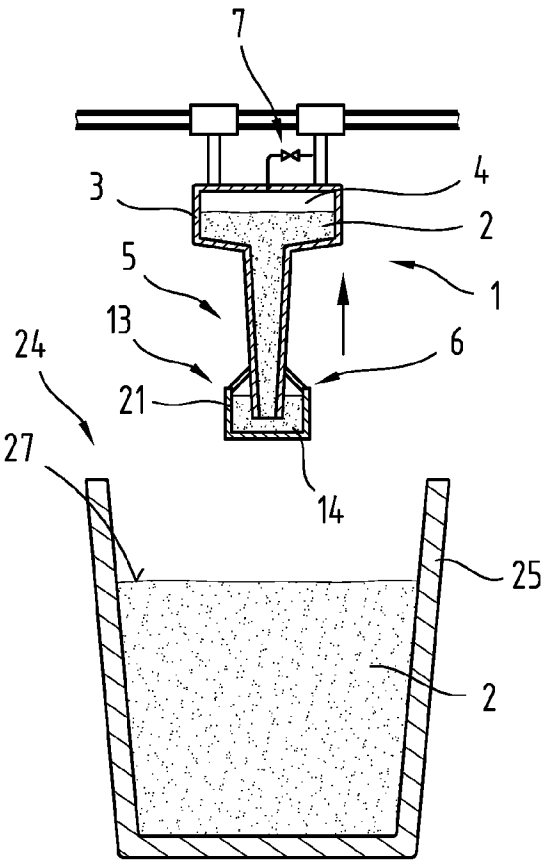
Figure 3B:
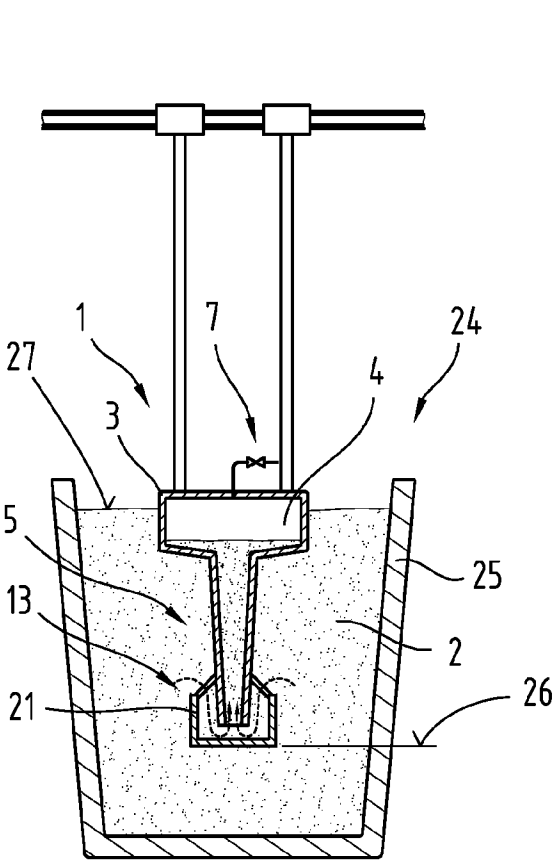
Figure 3A:
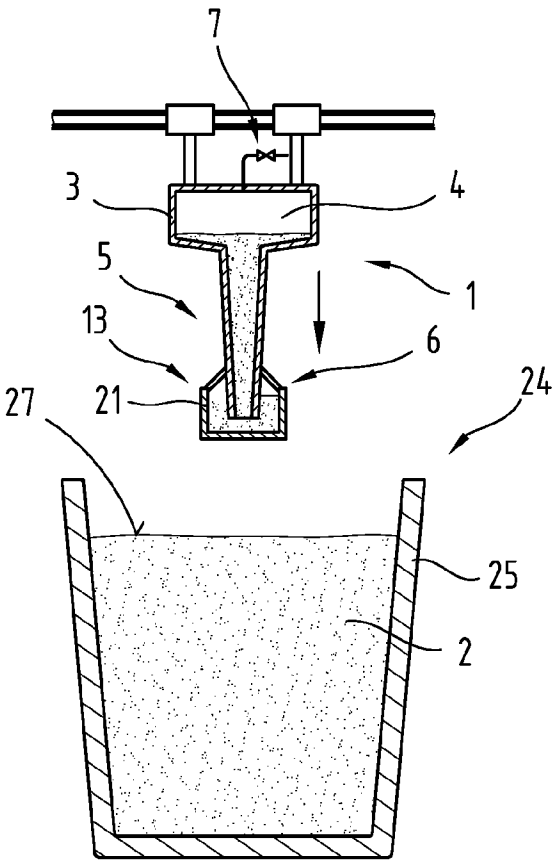

FIGS. 3*a* to 3*c* show a further and possibly independent embodiment of the melt transport device 1, wherein again, equal reference numbers and/or component designations are used for equal parts as in FIGS. 1 and 2 above. In order to avoid unnecessary repetitions, it is pointed to/reference is made to the detailed description in FIGS. 1 and 2 preceding it.

FIGS. 3*a* to 3*c* schematically show a possible filling operation for further and/or repeated filling of the melt receiving space 4 with melt 2.

As can be seen in FIG. 3*a,* it may be provided that directly before the renewed filling of the melt container 3, a remainder of melt 2, which has an oxide skin formed at the melt surface 19, is present in the melt receiving space 4 of the melt container 3. In other words, the melt 2 was not discharged completely during the previous casting operation. Of course, multiple cast workpieces may have been cast, wherein casting the last cast workpiece did not use up the entirety of the melt 2 located in the melt receiving space 4 of the melt container 3.

FIG. 3*a* does not show this situation explicitly, however, it is possible that prior to the immersion of the melt container 3 in the crucible 25, at least a part of the melt 2 still present in the melt receiving space 4 of the melt container 3 is discharged, so that this melt jet tears open and displaces the oxide skin of the melt 2 in the crucible 25.

Figure 4A:
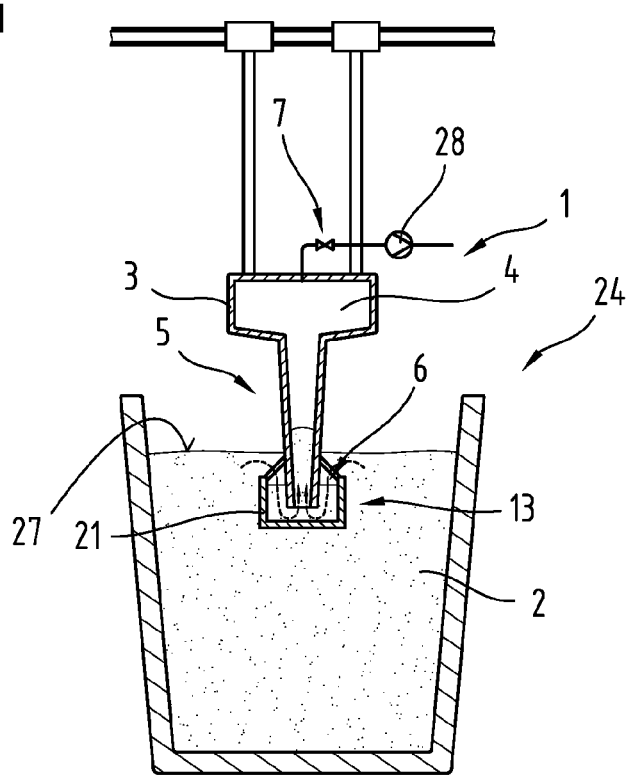
Figure 4B:
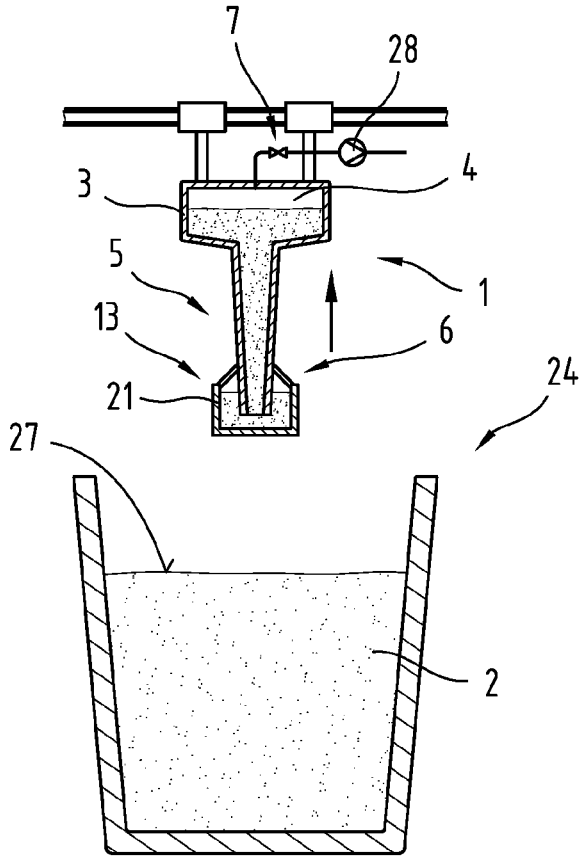

FIGS. 4*a* and 4*b* show a further and possibly independent embodiment of the melt transport device 1, wherein again, equal reference numbers and/or component designations are used for equal parts as in FIGS. 1 to 2 above. In order to avoid unnecessary repetitions, it is pointed to/reference is made to the detailed description in FIGS. 1 through 2 preceding it.

FIGS. 4*a* and 4*b* show an alternative method for filling the melt receiving space 4 with melt 2.

As can be gathered from FIGS. 4*a* and 4*b,* it may be provided that the melt container 3 is immersed in the crucible 25 only far enough for the spout orifice 6 to lie below the crucible fill level 27.

In order to then reach the target fill quantity level 12 in the melt receiving space 4, the melt receiving space 4 can be evacuated by means of a vacuum pump 28, whereby the melt 2 is sucked into the melt receiving space 4. Subsequently, the gas valve 7 can be closed in order to keep the actual fill quantity level 11 in the melt receiving space 4 at a constant level during the transport of the melt transport device 1.

As the melt receiving space 4 is already evacuated by means of the vacuum pump 28 prior to the lifting of the melt container 3, as shown in FIG. 4*b,* the actual fill quantity level 11 in the melt receiving space 4 will change only slightly during lifting.

FIG. 5 shows a further and possibly independent embodiment of the melt transport device 1, wherein again, equal reference numbers and/or component designations are used for equal parts as in FIGS. 1 to 4 above. In order to avoid unnecessary repetitions, it is pointed to/reference is made to the detailed description in FIGS. 1 through 4 preceding it.

As can be gathered from FIG. 5, it may be provided that the melt transport device 1 is filled by means of a low-pressure furnace 33 known to the person skilled in the art. In this regard, a riser tube 34, which projects into the crucible 25 of the low-pressure furnace 33, can be coupled directly to the spout orifice 6 in order to establish a flow connection between the riser tube 34 and the melt receiving space 4. If the gas valve 7 is opened during the filling operation, the melt 2 can be pushed upwards in the riser tube 34 due to the function of the low-pressure furnace 33 until the melt receiving space 4 is filled with melt 2 up to its target fill quantity level 12.

In such an embodiment variant, it may additionally be provided that the riser tube 34 of the low-pressure furnace 33 and the spout 5 are coupled to one another by means of a coupling 31.

FIGS. 6 to 9 each show a further and possibly independent embodiment of the siphon 13, wherein again, equal reference numbers and/or component designations are used for equal parts as in FIGS. 1 to 5 above. In order to avoid unnecessary repetitions, it is pointed to/reference is made to the detailed description in FIGS. 1 through 5 preceding it.

As is further evident from FIGS. 6 to 9, it can be provided that the siphon 13 has a tubular design. FIGS. 6 through 9 show different embodiment options of the spout orifice 6.

In the exemplary embodiment according to FIG. 6, the spout orifice 6 is round. Such a shape of the spout orifice 6 results when the tube forming the siphon 13 is cut off normal to the tube central axis.

In the exemplary embodiment according to FIG. 7, it is provided that a drain projection 35 is formed on the spout orifice 6. The drain projection 35 serves to keep the oxide adherence on the spout orifice 6 during the casting of a cast workpiece to a minimum. In the exemplary embodiment according to FIG. 7, the spout orifice 6 is also, like in the exemplary embodiment according to FIG. 6, arranged at a right angle relative to the tube central axis. In the exemplary embodiment according to FIG. 6 and FIG. 7, the tube is formed to be inclined sightly downwards in the region of the spout orifice 6 while the lance 20 is in a vertical position, wherein a tube end angle 36 is formed with an angle of less than 90°.

In the exemplary embodiment according to FIG. 8, the tube is cut obliquely in the region of the spout orifice 6, so that the spout orifice 6 has an oval shape.

As is evident from FIG. 9, it may be provided that the spout orifice 6 has a fan-shaped design, thus having a greater extension in its width than the extension in its height. A spout orifice 6 with such a design is particularly suitable for casting wide cast workpieces.

FIG. 10 shows a further and possibly independent embodiment of the casting device 37, wherein again, equal reference numbers and/or component designations are used for equal parts as in FIGS. 1 through 9 above. In order to avoid unnecessary repetitions, it is pointed to/reference is made to the detailed description in FIGS. 1 through 9 preceding it.

FIG. 10 shows a first exemplary embodiment of a casting device 37 which serves to cast workpieces. As can be seen in FIG. 10, it can be provided that the melt transport device 1 has a first melt container 3*a* and a second melt container 3*b*. The first melt container 3*a* has a first melt receiving space 4*a* and a first spout 5*a* in the form of a lance 20*a* located on the bottom on the first melt container 3*a*. The spout 5*a* has a spout orifice 6*a*.

As is further evident from FIG. 10, it may be provided that the second melt container 3*b* may be formed having the same design as the first melt container 3*a*.

The second melt container 3*b* has a second melt receiving space 4*b* and a second spout 5*b* in the form of a lance 20*b* located on the bottom on the second melt container 3*b*. The spout 5*b* has a spout orifice 6*b*.

The melt transport device 1 may be designed such that both melt containers 3*a*, 3*b* can be moved simultaneously and synchronously with one another. In particular, it may be provided that both melt containers 3*a*, 3*b* can be moved jointly by means of shared drive devices. Thereby, the structure of the melt transport device 1 can be kept as simple as possible.

The casting device 37 furthermore comprises a mold 29, which has a mold cavity 30. In particular, a first mold 29*a* is assigned to the first melt container 3*a*, and a second mold 29*b* is assigned to the second melt container 3*b*. By means of the casting device 37 shown in FIG. 10, two cast workpieces can be cast with only one melt transport device 1. Here, the structure and/or the control of the melt transport device 1 can be kept as simple as possible.

As is further evident from FIG. 10, it may be provided that a pivoting device 40 is formed, which has a pivot bearing 41, by means of which the melt containers 3*a*, 3*b* are pivotable about a horizontal axis of rotation 42. As can be seen in FIG. 10, it can be provided that each of the melt containers 3*a*, 3*b* has its own pivot drive 43. The two melt containers 3*a*, 3*b* can thus be pivoted individually and independently of one another.

Furthermore, it may be provided that the mold 29 can also be pivoted about a horizontal axis. Thus, the mold 29 and the melt container 3 can be pivoted simultaneously.

As can further be gathered from FIG. 10, it may be provided that a distance adjusting device 44 is formed, by means of which a distance 45 between the lance 20*a* of the first melt container 3*a* and the lance 20*b* of the second melt container 3*b* can be adjusted.

The distance adjusting device 44 can be designed, for example, in the form of a linear adjusting device, as can be seen in FIG. 10.

In a further embodiment, it is also conceivable that the distance adjusting device 44 is designed, for example, in the form of a fastening arm for receiving the melt containers 3*a*, 3*b*, wherein a change in the distance 45 can be achieved by pivoting the fastening arm and thus the melt containers 3*a*, 3*b* about a vertical axis.

FIG. 11 shows a further and possibly independent embodiment of the casting device 37, wherein again, equal reference numbers and/or component designations are used for equal parts as in FIGS. 1 through 10 above. In order to avoid unnecessary repetitions, it is pointed to/reference is made to the detailed description in FIGS. 1 through 10 preceding it. In particular, the casting device 37 shown in FIG. 11 has a similar structure to that of the casting device 37 shown in FIG. 10.

As is evident from FIG. 11, it may be provided that both melt containers 3*a*, 3*b* are arranged on a shared receptacle, wherein the pivot bearing 41 is designed such that both melt containers 3*a*, 3*b* can be pivoted simultaneously about the horizontal axis of rotation 42 by means of a pivot drive 43.

FIG. 12 shows a further and possibly independent embodiment of the casting device 37, wherein again, equal reference numbers and/or component designations are used for equal parts as in FIGS. 1 through 11 above. In order to avoid unnecessary repetitions, it is pointed to/reference is made to the detailed description in FIGS. 1 through 11 preceding it.

As can be seen in FIG. 12, it may be provided that the lance 20 is coupled to the melt container 3 by means of a quick-release connector 46, in particular by means of a bayonet catch. In the present exemplary embodiment according to FIG. 12, a mold element is formed in the melt container 3, wherein a recess corresponding to the mold element is formed on the lance 20. When the lance 20 is mounted on the melt container 3 and rotated by a certain angle, a locking of the lance 20 on the melt container 3 can be achieved by means of the quick-release connector 46.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the technical teaching provided by the present invention lies within the ability of the person skilled in the art in this technical field.

The scope of protection is determined by the claims. Nevertheless, the description and drawings are to be used for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

LIST OF REFERENCE NUMBERS

| | |
|---|---|
| 1 | Melt transport device |
| 2 | Melt |
| 3 | Melt container |
| 4 | Melt receiving space |
| 5 | Spout |
| 6 | Spout orifice |
| 7 | Gas valve |
| 8 | Fill level maximum |
| 9 | Pressure determining means |
| 10 | Fill level sensor |
| 11 | Actual fill quantity level |
| 12 | Target fill quantity level |
| 13 | Siphon |
| 14 | Reservoir |
| 15 | Siphon wall |
| 16 | Melt container outer side |
| 17 | Overflow level |
| 18 | First melt surface |
| 19 | Second melt surface |
| 20 | Lance |
| 21 | Container |
| 22 | Strut |
| 23 | Spout channel |
| 24 | Melt furnace |
| 25 | Crucible |
| 26 | Filling position |
| 27 | Crucible fill level |
| 28 | Vacuum pump |
| 29 | Mold |
| 30 | Mold cavity |
| 31 | Coupling |
| 32 | Siphon wall bottom edge |
| 33 | Low-pressure furnace |
| 34 | Riser tube |
| 35 | Drain projection |
| 36 | Tube end angle |
| 37 | Casting device |
| 38 | Surface melt receiving space |
| 39 | Weighing cell |
| 40 | Pivoting device |
| 41 | Pivot bearing |
| 42 | Horizontal axis of rotation |
| 43 | Pivot drive |
| 44 | Distance adjusting device |
| 45 | Distance |
| 46 | Quick-release connector |
| 47 | Immersion aid |

The invention claimed is:

1. A method for casting a melt (2) by means of a melt container (3) in which a melt receiving space (4) is formed, wherein the melt container (3) has a spout (5) in the form of a lance (20) located on the bottom on the melt container (3), wherein the method comprises the following method steps:

filling the melt container (3) with melt (2), wherein the melt (2) is introduced into the melt receiving space (4) of the melt container (3) out of a crucible (25) by means of a spout orifice (6) of the lance (20);

casting at least one cast workpiece with melt (2) from the melt container (3), wherein the melt (2) received in the melt receiving space (4) is introduced into a mold (29) via the spout orifice (6) of the lance (20);

filling the melt container (2) with melt (3) again, wherein during the filling of the melt container (3) with melt (2), so much more melt (2) is received in the melt receiving space (4) than is required for casting the cast workpiece that directly before the renewed filling of the melt container (3), a remainder of melt (2), which has an oxide skin formed at a melt surface (19), is present in the melt receiving space (4) of the melt container (3), wherein the level of a melt surface (19) of the melt remaining in the melt receiving space (4) lies above the lance (20) inside the melt receiving space (4).

2. The method according to claim 1, wherein for filling the melt receiving space (4) of the melt container (3), the lance (20) is immersed in a crucible (25) filled with melt (2) such that the spout orifice (6) of the lance (20) lies below a crucible fill level (27) during the entire filling operation.

3. The method according to claim 2, wherein directly before immersing the lance (20) in the crucible (25), at least a part of the melt (2) remaining in the melt receiving space (4) of the melt container (3) is discharged into the crucible (25).

4. The method according to claim 1, wherein the melt receiving space (4) of the melt container (3) has a non-wettable surface (38), to which the oxide skin of the melt (2) does not adhere.

5. The method according to claim 1, wherein while filling the melt container (3) with melt (2), between 1% and 30%, more melt (2) is received in the melt receiving space (4) than is required for casting the cast workpiece.

6. The method according to claim 1, wherein the melt receiving space (4) of the melt container (3) is emptied completely in periodic intervals and/or before shutting down the melt container (3), and the oxide skin is blown out of the melt receiving space (4) by means of a gas blast.

7. The method according to claim 1, wherein the oxide skin present in the melt receiving space (4) at the surface of the melt (2) is sucked off in periodic intervals and/or before shutting the melt container (3) down.

8. The method according to claim 1, wherein the oxide skin present in the melt receiving space (4) at the surface of the melt (2) is removed by means of an oxide skin discharge orifice formed in the melt container (3).

9. The method according to claim 1, wherein the melt receiving space (4) is designed such that when it is at least partially filled with melt (2), it is closed off in a gas-tight manner, wherein a gas valve (7) is formed, by means of which gas can be fed into or removed from the melt receiving space (4), wherein the gas valve (7) is opened while the melt container (3) is being filled with melt (2), so that the melt (2) can flow out of the crucible (25) and into the melt receiving space (4) via the lance (20), and the gas valve (7) is closed after the melt (2) has flown in, and subsequently, while the gas valve (7) is closed, melt (2) is discharged from the melt receiving space (4) back into the crucible (25) via the lance (20) until a vacuum is generated that is sufficient to keep the remaining melt (2) in the melt receiving space (4).

10. The method according to claim 1, wherein when casting the at least one cast workpiece, the melt (2) is admitted, in a first method step, from the melt container (3*a*, 3*b*) into the mold (29*a*, 29*b*) at a first inflow speed until the spout orifice (6) is immersed at least partially in the melt (2) introduced into the mold (29*a*, 29*b*), and that wherein in a second method step, the melt (2) is admitted into the mold (29*a*, 29*b*) at a second inflow speed, wherein the second inflow speed is greater than the first inflow speed.

11. The method according to claim 1, wherein while filling the melt container (3*a*, 3*b*) with melt (2), in a first method step, the lance (20) is moved, in particular pivoted, at the surface of the crucible (25) such that the oxide skin at the surface is torn open, and in a second method step, the lance (20) is immersed in the melt present in the crucible (25) in the torn region of the oxide skin.

* * * * *